United States Patent [19]

Hollweck

[11] 4,445,107

[45] Apr. 24, 1984

[54] THERMOSTATIC SWITCH FOR ELECTRICALLY HEATED DEVICES

[75] Inventor: Walter Hollweck, Nuremberg, Fed. Rep. of Germany

[73] Assignee: Inter Control Hermann Köhler Elektrik GmbH & Co. KG, Nuremberg, Fed. Rep. of Germany

[21] Appl. No.: 398,245

[22] Filed: Jul. 14, 1982

[30] Foreign Application Priority Data

Jul. 15, 1981 [DE] Fed. Rep. of Germany ..... 3127852

[51] Int. Cl.[3] ..... H01H 37/74

[52] U.S. Cl. ..... 337/343; 337/349; 337/365

[58] Field of Search ..... 337/342, 343, 348, 349, 337/365

[56] References Cited

U.S. PATENT DOCUMENTS 3,936,788 2/1976 Uchiya ..... 337/343 X 4,278,960 7/1981 Muller et al. ..... 337/365

FOREIGN PATENT DOCUMENTS 2821457 11/1979 Fed. Rep. of Germany ..... 337/342

*Primary Examiner*—George Harris

*Attorney, Agent, or Firm*—Spencer & Frank

[57] ABSTRACT

A thermostatic switch for controlling an electrically heated device, composed of an insulating body carrying a countercontact, a bimetal disc, and a contact spring having a first end secured to the body, a second end which is movable relative to the first end and which carries a contact located to cooperate with the countercontact, and portions mounting the bimetal disc for controlling the movement of the contact as a function of temperature, the contact spring presenting longitudinal edges extending between its ends, wherein the mounting portions include angled extension portions extending from the longitudinal edges of the spring for restraining movement of the disc in the direction transverse to the edges.

1 Claim, 4 Drawing Figures

THERMOSTATIC SWITCH FOR ELECTRICALLY HEATED DEVICES

BACKGROUND OF THE INVENTION

The present invention relates to a thermostatic switch for monitoring electrically heated devices, the switch being of the type including an insulating substrate on which one end of a contact spring is fastened, with the free end of the spring, being provided with a contact which cooperates with a countercontact likewise fixed on the insulating body, the switch further including electrical leads and a bimetal disc which is in operative connection with the contact spring so that if a predetermined temperature is reached, the contacts are opened or closed.

German Offenlegungsschrift [Laid-Open Application] No. 2,821,457.5 discloses a switch in which one side of a contact spring is connected to an insulating body with the free end of the spring being provided with a contact that cooperates with a countercontact fixed to the insulating body. One or a plurality of bimetal discs are in operative connection with this contact spring and the bimetal discs are each provided with a hole in its center to form a concentric mount on the contact spring.

A drawback of this design is the limited service life of the bimetal discs since the number of possible switchings is reduced by the effect of the center hole. With repeated switchings there exists the danger that cracks develop in the bimetal disc starting at the center hole, reducing the original tensioned state of the disc so that proper snapping is no longer assured. This would have an effect on the switching behavior of the contacts, i.e. with such bimetal discs momentary opening and closing of the contacts would no longer be possible.

To overcome this drawback, German Offenlegungsschrift No. 2,904,341, which is for a Patent of Addition to the above-cited application, proposes a design for the contact spring such that bimetal discs can be arranged at the contact spring without having a center hole. The contact spring here is given a stamped curvature in its center and resilient flaps at its two longitudinal sides which have one end fixed to the contact spring and are angled at their other, free ends. Both resilient flaps are slightly prebent in the same direction as the stamped-in curvature in the center of the contact spring.

The bimetal disc is held, on the one hand, by L-shaped flaps extending from the contact spring and, on the other hand, by the resilient flaps disposed at its longitudinal sides.

A particular drawback of this design of the contact spring has been found to be the fact that if an external mechanical force acts on the two resilient flaps, for example during transport or installation of the temperature switch in an electrical device, the bimetal disc is laterally displaced out of its mount and thus comes loose from the contact spring.

A further drawback of the resilient flaps is the different contact pressure occurring at the contact spring as a result of nonuniform angulation or subsequent bending of the flaps.

SUMMARY OF THE INVENTION

It is an object of the present invention to improve a temperature switch of the above-described type in such a manner that secure adherence of the bimetal disc on the contact spring is assured even if the temperature switch is influenced by external mechanical action.

The above and other objects are achieved according to the present invention in that in a temperature switch of the type described above, each of the two longitudinal edges of the contact spring is given an angled extension, preferably in the center of each edge, and this extension serves to delimit the sides of the bimetal disc disposed on the contact spring.

The bimetal disc is arranged on the contact spring in such a manner that it is held, on the one hand, by L-shaped flaps projecting from the contact spring and, on the other hand, as provided by the present invention, by the angled extensions disposed at the longitudinal edges of the contact spring.

According to the invention, closed longitudinal slits are provided in the contact spring in the region of its longitudinal edges so that the angled extensions are resiliently bent outwardly when the bimetal disc is attached to the contact spring without the entire contact spring having to be bent. When the bimetal disc has reached its end position, the extension snaps over the edge of the bimetal disc so that the disc is securely fixed there.

The L-shaped flaps projecting from the contact spring have arms which extend toward the center and are bent obliquely upwardly so that the width of the opening between the arm ends and the contact spring, which has thus been enlarged, assures smooth insertion of the bimetal disc.

This design of the contact spring is of particular advantage because the easy installation of the bimetal disc reduces breakdowns in the automated manufacture of such switches.

Tilting of the bimetal disc is no longer possible because of the flat shape of the contact spring.

If the bimetal disc is heated, its edge zone is supported at the L-shaped flaps and its center at a stamped-in curvature in the center of the contact spring. The contact spring here inevitably follows the curvature of the bimetal disc so that the contacts are opened.

The angled extensions at the longitudinal edges of the contact spring are preferably dimensioned in such a way that in the switched state the edge of the bimetal disc lies lower than the end of the extensions.

The invention will now be explained in greater detail with the aid of the drawings.

DESCRIPTION OF THE PREFERRED EMBODIMENTS

Figure 1:
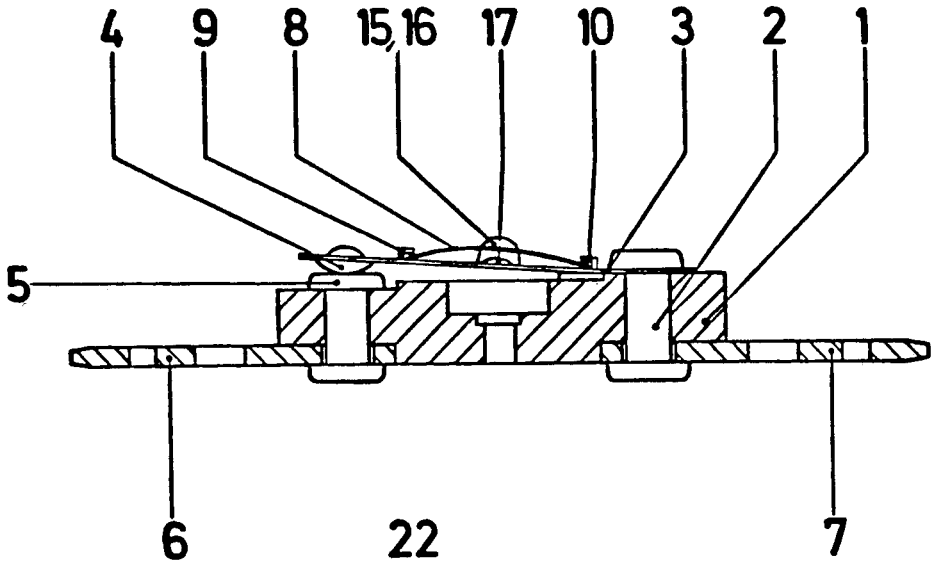
FIG. 1 is an elevational, cross-sectional view of a preferred embodiment of a thermostatic switch according to the invention in the rest state.
Figure 2:
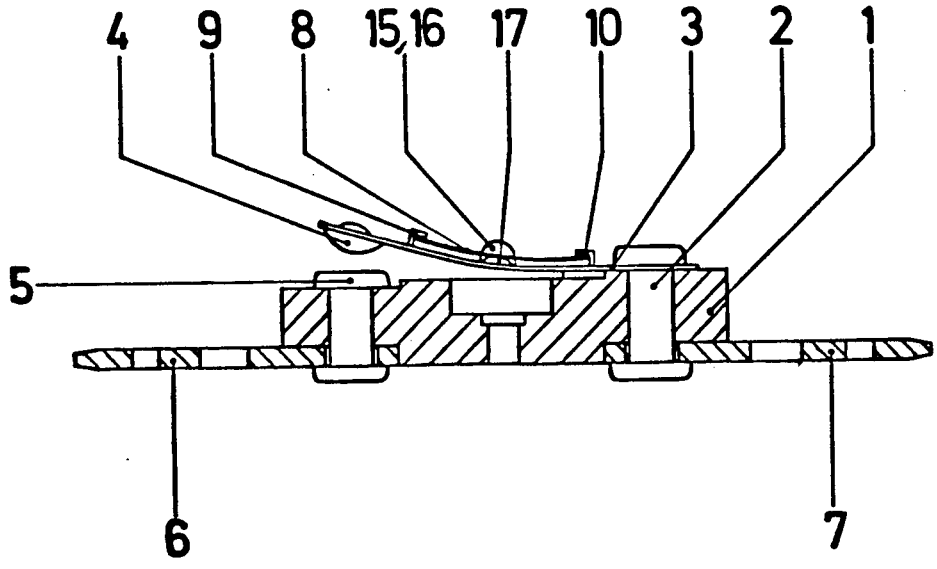
FIG. 2 is a view similar to that of FIG. 1 of the switch with its contacts open.

In the switch shown in FIGS. 1 and 2, one end of a contact spring 3 is fastened by means of a rivet 2 to an insulating body 1. At its other end, which is its free end, the contact spring 3 is provided with a contact 4 which cooperates with a countercontact 5 likewise fastened by riveting on the insulating body 1. The contact spring 3 is here tensioned to urge contact 4 in the direction toward the countercontact 5. The countercontact 5 is simultaneously designed as a contact rivet with which an electrical lead 6 is held at the insulating body 1. A second electrical terminal is likewise fastened by means of rivet 2.

A bimetal disc 8 is mounted on the contact spring 3 in such a manner that, on the one hand, it is held by L-shaped flaps 9 and 10 projecting from the contact spring 3 and, on the other hand, it is laterally positioned by angled extensions 15 and 16 disposed at the longitudinal edges of the contact spring 3.

Figure 3:
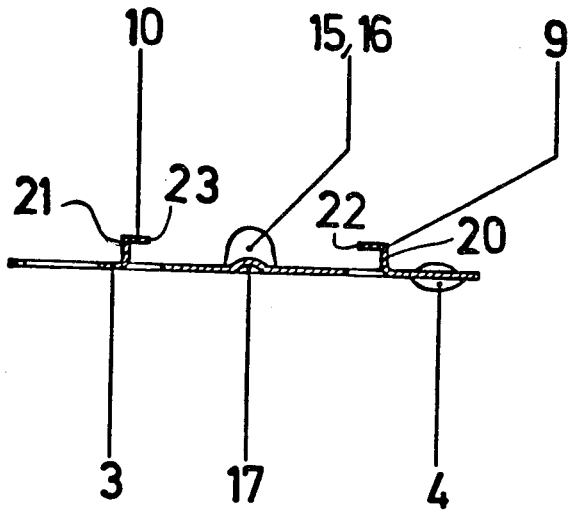
FIG. 3 is an elevational, cross-sectional view of the contact spring of the switch of FIGS. 1 and 2.
Figure 4:
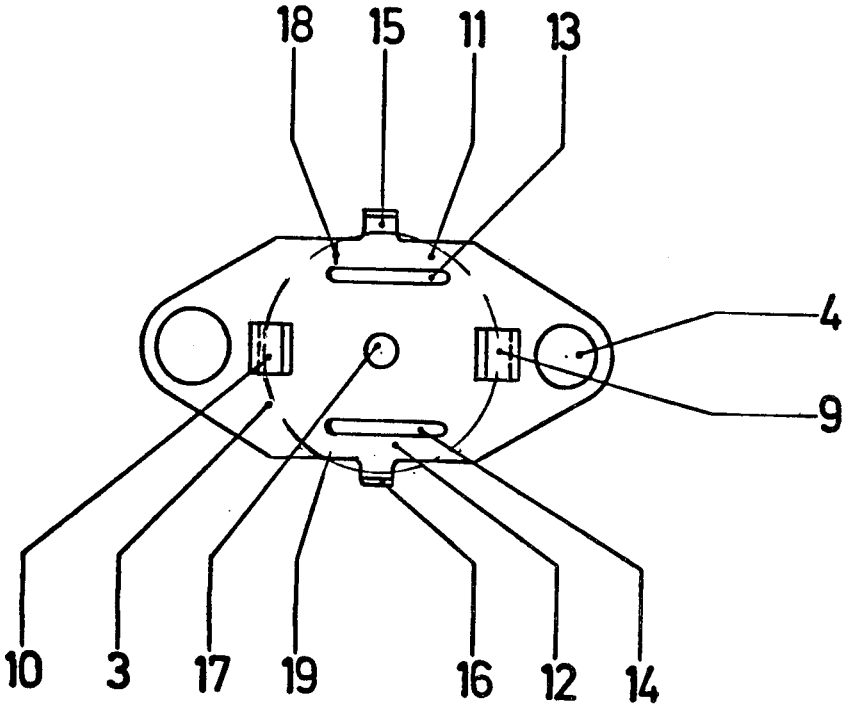
FIG. 4 is a top plan view of the contact spring of FIG. 3.

As can be seen in FIGS. 3 and 4, the contact spring 3 is provided with closed, longitudinally extending slits 13 and 14 adjacent its longitudinal edges and separated from extensions 15 and 16 by regions 18 and 19.

The angled extensions 15 and 16 at the contact spring 3 prevent, in particular, lateral displacement of the bimetal disc in its two switching positions since the edge zones of the bimetal disc 8 which are in line with regions 18 and 19 lie lower than the ends of the extensions 15 and 16, respectively.

The arms 20 and 21 of the L-shaped flaps 9 and 10, respectively, are bent obliquely upwardly so that the thus enlarged dimension of the opening between the flap ends 22 and 23 facilitates smooth insertion of the bimetal disc 8.

When the bimetal disc 8 is heated to a sufficient temperature, its direction of curvature changes suddenly. The disc is then supported in its center by a stamped-in protrusion 17 in the center of the contact spring 3 and in its end regions by the L-shaped flaps 9 and 10 of the contact spring 3. The contact spring 3 thus inevitably follows the curvature of the bimetal disc 8 so that the contacts 4 and 5 are opened.

The shape of the bimetal disc 8 is shown in FIG. 4 in broken lines. The closed longitudinal slits 13 and 14 are provided in the contact spring 3 in the region of its longitudinal edges so that the angled extensions 15, 16 can be bent outwardly when the bimetal disc 8 is attached to the contact spring 3 without the entire contact spring 3 having to be bent.

When the bimetal disc 8 has reached its end position, the extension snaps over the edge of the bimetal 8 so that it is securely fixed.

It will be understood that the above description of the present invention is susceptible to various modifications, changes and adaptations, and the same are intended to be comprehended within the meaning and range of equivalents of the appended claims.

What is claimed is:

1. A thermostatic switch for controlling an electrically heated device, comprising: an insulating body carrying a countercontact; a bimetal disc; and a contact spring having a first end secured to said body, a second end which is movable relative to said first end and which carries a contact located to cooperate with said countercontact, means mounting said bimetal disc for controlling the movement of said contact as a function of temperature, said contact spring presenting longitudinal edges extending between said ends, and closed slits adjacent said longitudinal edges; wherein said mounting means comprise angled extension portions extending from said longitudinal edges of said spring for restraining movement of said disc in the direction transverse to said edges and L-shaped holding portions projecting from said spring, spaced apart in the longitudinal direction of said spring, and having free edges directed toward one another, said holding portions being arranged to retain the ends of said disc.

* * * * *